US007376981B2

(12) United States Patent
Shida

(10) Patent No.: US 7,376,981 B2
(45) Date of Patent: May 27, 2008

(54) HELMET

(75) Inventor: Masayuki Shida, Machida (JP)

(73) Assignee: Shoei Co., Ltd. (JP)

( * ) Notice: Subject to any disclaimer, the term of this patent is extended or adjusted under 35 U.S.C. 154(b) by 65 days.

(21) Appl. No.: 11/724,437

(22) Filed: Mar. 15, 2007

(65) Prior Publication Data

US 2007/0226880 A1 Oct. 4, 2007

(30) Foreign Application Priority Data

Mar. 17, 2006 (JP) ..... 2006-074564

(51) Int. Cl.
*A42B 3/18* (2006.01)

(52) U.S. Cl. ..... 2/424

(58) Field of Classification Search ..... 2/410, 2/411, 421, 422, 424, 425, 10
See application file for complete search history.

(56) References Cited

U.S. PATENT DOCUMENTS 5,062,162 A * 11/1991 Kamata ..... 2/424
5,185,889 A * 2/1993 Kamata ..... 2/424
5,461,731 A * 10/1995 Shida ..... 2/424
6,226,803 B1 5/2001 Tanaka
6,301,721 B1 * 10/2001 Arai ..... 2/424
6,654,969 B2 * 12/2003 Taniuchi ..... 2/424
6,711,753 B2 * 3/2004 Arai ..... 2/424
7,065,798 B2 * 6/2006 Kuo ..... 2/424
7,210,174 B2 * 5/2007 Yeh ..... 2/424

FOREIGN PATENT DOCUMENTS

EP 1500340 A1 1/2005
JP 2000-096334 4/2000

* cited by examiner

*Primary Examiner*—Danny Worrell
(74) *Attorney, Agent, or Firm*—Jones Day

(57) ABSTRACT

A helmet in which a subsidiary cap portion hardly pivots forward about an axial support means thereof as a fulcrum to undesirably move upward accidentally when a comparatively large impact acts on the helmet. A subsidiary cap portion locking mechanism which locks the subsidiary cap portion at a lower position includes a lock pin on a main cap portion and a locking recess for a lock lever on the subsidiary cap portion. While the subsidiary cap portion is in a backward state, an angle that a third straight line, which extends in a direction along which the lock pin starts to disengage from the locking recess, forms with a second straight line obtained by extending a first straight line, which extends from the axial support means of the subsidiary cap portion to the lock pin, falls within a range between an angle which is upward from the second straight line by 65° (preferably 40° and more preferably 15°) and an angle which is downward from the second straight line by 85° (preferably 60° and more preferably 35°).

9 Claims, 10 Drawing Sheets

HELMET

TECHNICAL FIELD

The present invention relates to a helmet in which a head protecting body (to be merely referred to as a "cap portion" hereinafter) to be worn on the head of a helmet wearer (to be merely referred to as a "wearer" hereinafter) comprises a cap-like main cap portion and a subsidiary cap portion attached to the main cap portion by an axial support means to be reciprocally pivotal so as to selectively cover the wearer's chin, the cap portion is provided with a locking mechanism which locks the subsidiary cap portion with respect to the main cap portion when the subsidiary cap portion is in a backward state where the subsidiary cap portion covers the chin, and the locking mechanism comprises a lock pin provided to the main cap portion, and a lock lever having a locking recess, with which the lock pin is engageable relatively when the subsidiary cap portion is in the backward state, and provided to the subsidiary cap portion.

BACKGROUND OF THE INVENTION

As vehicle helmets worn by a motorcycle rider or the like, a full-face-type helmet and a jet-type helmet are conventionally known. In the full-face-type helmet, a chin cover for covering the wearer's chin is integrally formed with the cap portion. In the jet-type helmet, no chin cover is formed on the cap portion so as to expose the face of the wearer substantially entirely. Another full-face-type helmet (to be referred to as a "full-face-type helmet serving also as a jet-type helmet" hereinafter) is also conventionally known, as is disclosed in U.S. Pat. No. 6,226,803 B1. In this full-face-type helmet, the cap portion comprises a main cap portion having substantially the same shape as that of the cap portion of a jet-type helmet, and a subsidiary cap portion attached to the main cap portion to be vertically pivotal so as to selectively cover the wear's chin, so that the helmet can have the functions of both a full-face-type helmet and a jet-type helmet.

In the conventional full-face-type helmet disclosed in U.S. Pat. No. 6,226,803 B1 and serving also as the jet-type helmet, when the subsidiary cap portion is at the lower position (i.e., in the lower state) or backward position (i.e., in the backward state), the subsidiary cap portion serves as a chin cover means. When the subsidiary cap portion is at the upper position (i.e., in the upper state) or forward position (i.e., in the forward state), a large window formed in the main cap portion is opened entirely, and the cap portion accordingly does not have a chin cover means, in the same manner as in the jet-type helmet. When the wearer wearing the full-face-type helmet serving also as the jet-type helmet, as disclosed in U.S. Pat. No. 6,226,803 B1, is driving a motor cycle at high speed, the helmet is worn with its subsidiary cap portion being lowered to the lower position, in order to prevent a large wind pressure from acting on the wearer's chin and its vicinity. The helmet of U.S. Pat. No. 6,226,803 B1 is also provided with a subsidiary cap portion locking mechanism for locking the subsidiary cap portion at the lower position with respect to the main cap portion, so that a large impact or wind pressure does not undesirably let the subsidiary cap portion move upward during high-speed driving. Furthermore, the subsidiary cap portion locking mechanism in the helmet of U.S. Pat. No. 6,226,803 B1 comprises a release button serving as an unlocking means or unlocking member so as to unlock the subsidiary cap portion locked at the lower position. When the wearer presses the release button for unlocking, the subsidiary cap portion at the lower position is unlocked.

In the full-face-type helmet serving also as the jet-type helmet as described above disclosed in U.S. Pat. No. 6,226,803 B1, while the wearer wears the helmet with the subsidiary cap portion being lowered to the lower position, when a comparatively large impact acts on the helmet in a direction to move the subsidiary cap portion upward, even if the wearer does not press the release button to unlock, the subsidiary cap portion may accidentally move upward. The reason for this will be described with reference to FIG. 15.

FIG. 15 shows the mutual positional relationship, seen from the side direction (that is, the side), among an attaching screw 7, lock lever 83 and lock pin 92 of the cap portion of the helmet of U.S. Pat. No. 6,226,803 B1 with the lower end opening of the cap portion of the helmet being substantially horizontal. Regarding the reference numerals of the respective portions in FIG. 15, portions that are common with those in FIG. 14 of an embodiment of the present invention (this FIG. 14 is a view similar to FIG. 15) are denoted by the same reference numerals. In FIG. 15, the attaching screw (axial support means) 7 attaches a subsidiary cap portion 6 to a main cap portion 5 to be reciprocally pivotal. A rivet 84 pivotally attaches the lock lever 83 to an attaching base (not shown). The lock lever 83 has a locking recess 94. In the state of FIG. 15 (that is, when the subsidiary cap portion 6 is in the lower state), the lock pin 92 engages with the locking recess 94. The lock lever 83 is also provided with a wire attached portion 86 and stopped portion 85. A spherical body 119, having a free end to which a tractive wire portion 75*c* fixes, attaches to the wire attached portion 86. The stopped portion 85 is inserted in an incision in the attaching base.

In FIG. 15 which shows the helmet of U.S. Pat. No. 6,226,803 B1, reference symbol $L_1$ denotes the first straight line extending from the center of the attaching screw 7 to the center of the lock pin 92. The intermediate portion of the first straight line $L_1$ is omitted. Reference symbol $L_2$ denotes the second straight line obtained by extending the first straight line $L_1$ from the center of the lock pin 92 in a direction opposite to the center of the attaching screw 7 so as to be identical with the first straight line $L_1$. Reference symbol $L_3$ denotes the third straight line extending from the center of the lock pin 92 in a direction along which the lock pin 92 starts to relatively disengage from the locking recess 94 upon forward pivot motion (that is, clockwise pivot motion in FIG. 15) of the lock lever 83 about the center of the rivet (axial support means) 84 as the pivot fulcrum. The third straight line $L_3$ is substantially perpendicular to a fourth straight line $L_4$ which connects the center of the rivet 84 to the center of the lock pin 92 and faces in a direction substantially opposite to the second straight line $L_2$. Hence, an angle $\theta_1$ that the third straight line $L_3$ forms with the second straight line $L_2$ is substantially equal to or near 180° (more specifically, an upward angle of about 175°).

In FIG. 15 which shows the helmet of U.S. Pat. No. 6,226,803 B1, the angle $\theta_1$ that the second straight line $L_2$ forms with the third straight line $L_3$ is substantially equal to or near 180°. Hence, the pivot direction along which the subsidiary cap portion 6 starts to move upward and the pivot direction along which the lock lever 83 starts to pivot forward about the rivet 84 as the fulcrum so as to relatively disengage the lock pin 92 from the locking recess 94 face substantially the same side (in other words, clockwise in FIG. 15). Therefore, assume that a comparatively large impact that is to pivot the subsidiary cap portion 6 forward from the backward position shown in FIG. 15 acts on the helmet. If the lock lever 83, rivet 84, lock pin 92, or the like deforms elastically or in other manners, the lock pin 92 accidentally disengages relatively from the locking recess 94 of the lock lever 83, and the subsidiary cap portion 6 may pivot forward about the attaching screw 7 as the fulcrum undesirably to accidentally move upward, partly because an elastic biasing means such as a spring biases the subsidiary cap portion 6 in the forward pivot direction.

SUMMARY OF THE INVENTION

The present invention has been made to solve the problems as described above in the helmet of U.S. Pat. No. 6,226,803 B1.

According to the present invention, there is provided a helmet in which a cap portion to be worn on a head of a wearer comprises a cap-like main cap portion and a subsidiary cap portion attached to the main cap portion by axial support means to be reciprocally pivotal so as to selectively cover a wearer's chin, the cap portion is provided with a locking mechanism which locks the subsidiary cap portion with respect to the main cap portion when the subsidiary cap portion is in a backward state where the subsidiary cap portion covers the chin, and the locking mechanism comprises a lock pin provided to the main cap portion, and a lock lever having a locking recess, with which the lock pin is engageable relatively when the subsidiary cap portion is in the backward state, and provided to the subsidiary cap portion, characterized in that an angle that a third straight line, which extends from a center of the lock pin in a direction along which the lock pin starts to relatively disengage from the locking recess in the backward state, seen from the side direction of the cap portion, forms with a second straight line obtained by extending a first straight line, which extends from the center of the axial support means to the center of the lock pin in the backward state, seen from the side direction of the cap portion, from the center of the lock pin in a direction opposite to the center of the axial support means so as to be substantially identical with the first straight line, falls within a range between an angle which is upward from the second straight line by 65° and an angle which is downward from the second straight line by 85°.

According to the present invention, preferably, the angle that the third straight line forms with the second straight line falls within a range between an angle which is upward from the second straight line by 40° and an angle which is downward from the second straight line by 60°. More preferably, the angle that the third straight line forms with the second straight line falls within a range between an angle which is upward from the second straight line by 15° and an angle which is downward from the second straight line by 35°. Further preferably, the angle that the third straight line forms with the second straight line is directed more downward from the second straight line by an angle larger than 0° and smaller than 20°. Most preferably, the angle that the third straight line forms with the second straight line falls within a range between an angle which is downward from the second straight line by 5° and an angle which is downward from the second straight line by 15°. The axial support means can comprise an attaching screw.

According to the present invention, the pivot direction along which the subsidiary cap portion starts to move upward and the pivot direction along which the lock lever starts to pivot forward about the axial support means as the fulcrum so as to relatively disengage the lock pin from the locking recess face substantially the opposite sides. Therefore, assume that a comparatively large impact that is to pivot the subsidiary cap portion forward from the backward position acts on the helmet. Even if the lock lever, axial support means, lock pin, or the like deforms elastically or in other manners, the lock pin hardly accidentally disengages relatively from the locking recess of the lock lever. Thus, even if an elastic biasing means such as a spring biases the subsidiary cap portion in the forward pivot direction, the subsidiary cap portion will hardly pivot forward about the axial support means as the fulcrum undesirably to accidentally move upward. When the wearer moves the unlocking means such as a release button forward to relatively disengage the lock lever from the lock pin, even if the angle of the forward pivot motion of the lock lever is comparatively small, the lock lever will not come into contact again with the lock pin that has relatively disengaged from the lock lever, but can smoothly move upward as the subsidiary cap portion accompanies it.

According to another aspect of the present invention, preferably, while the subsidiary cap portion is in the backward state, the pivot fulcrum of the lock lever, seen from the side direction of the head protecting body when a lower end opening of the head protecting body is in a substantially horizontal state, is located above a horizontal line which extends through the center of the lock pin. In this case, more preferably, while the subsidiary cap portion is in the backward state, the pivot fulcrum of the lock lever, seen from the side direction of the head protecting body when a lower end opening of the head protecting body is in the substantially horizontal state, is located under a second horizontal line which extends through the center of axial support means. The pivot fulcrum of the lock lever can comprise a rivet.

According to the above-mentioned another aspect of the present invention, when the wearer moves the unlocking means such as a release button forward to relatively disengage the lock lever from the lock pin, even if the angle of the forward pivot motion of the lock lever is further small, the lock lever will not come into contact again with the lock pin that has relatively disengaged from the lock lever, but can smoothly move upward as the subsidiary cap portion accompanies it.

The above, and other, objects, features and advantages of this invention will become readily apparent from the following detailed description thereof which is to be read in connection with the accompanying drawings.

DETAILED DESCRIPTION OF THE INVENTION

An embodiment in which the present invention is applied to a full-face-type helmet serving also as a jet-type helmet will be described in "1. Schematic Arrangement of Helmet as a Whole", "2. Arrangement of Release Button and Holding Mechanism for the Same", "3. Arrangement of Subsidiary Cap Portion Locking Mechanism" and "4. How To Use Helmet" with reference to the accompanying drawings.

1. Schematic Arrangement of Helmet as a Whole

Figure 1:
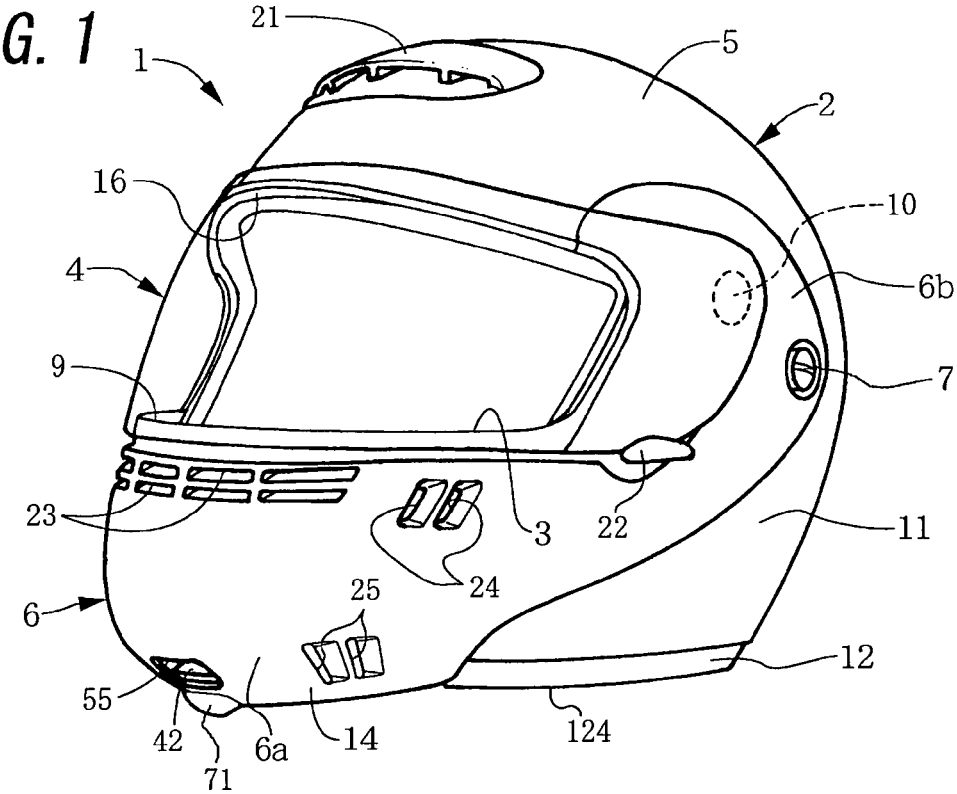
FIG. 1 is a perspective view of a helmet as a whole in one embodiment in which the present invention is applied to a full-face-type helmet serving also as a jet-type helmet, with the lower end opening of a head protecting body being substantially horizontal.
Figure 2:
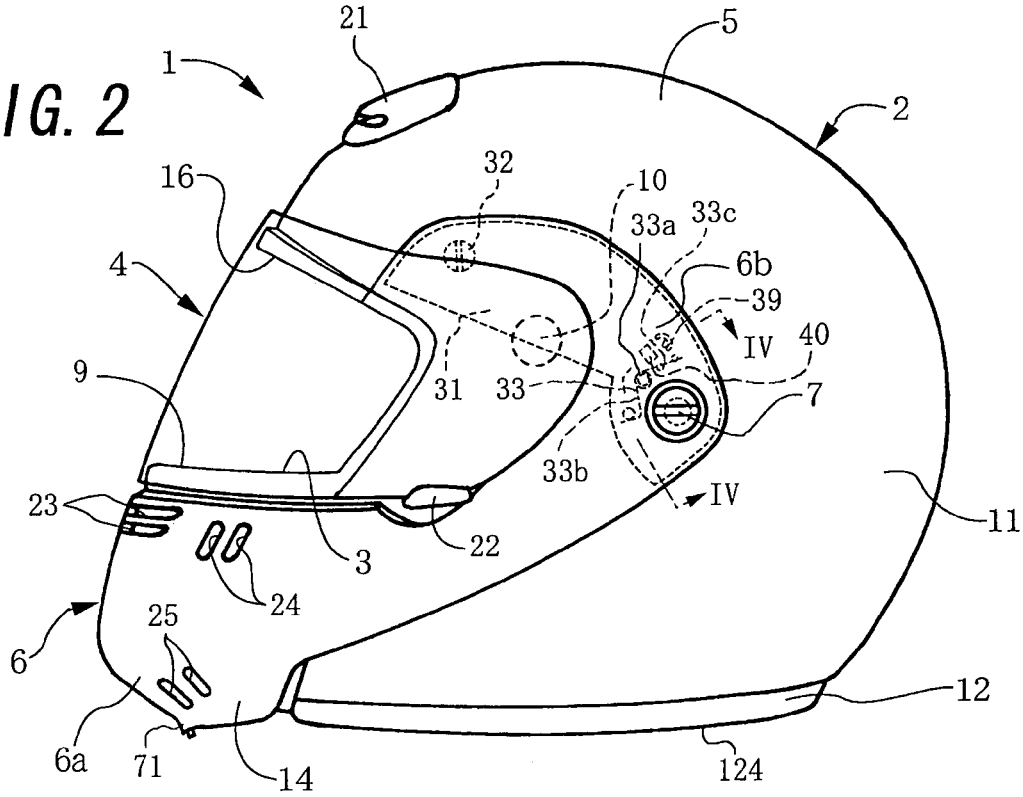
FIG. 2 is a right side view of the helmet shown in FIG. 1 as a whole with the lower end opening of the head protecting body being substantially horizontal.
Figure 3:
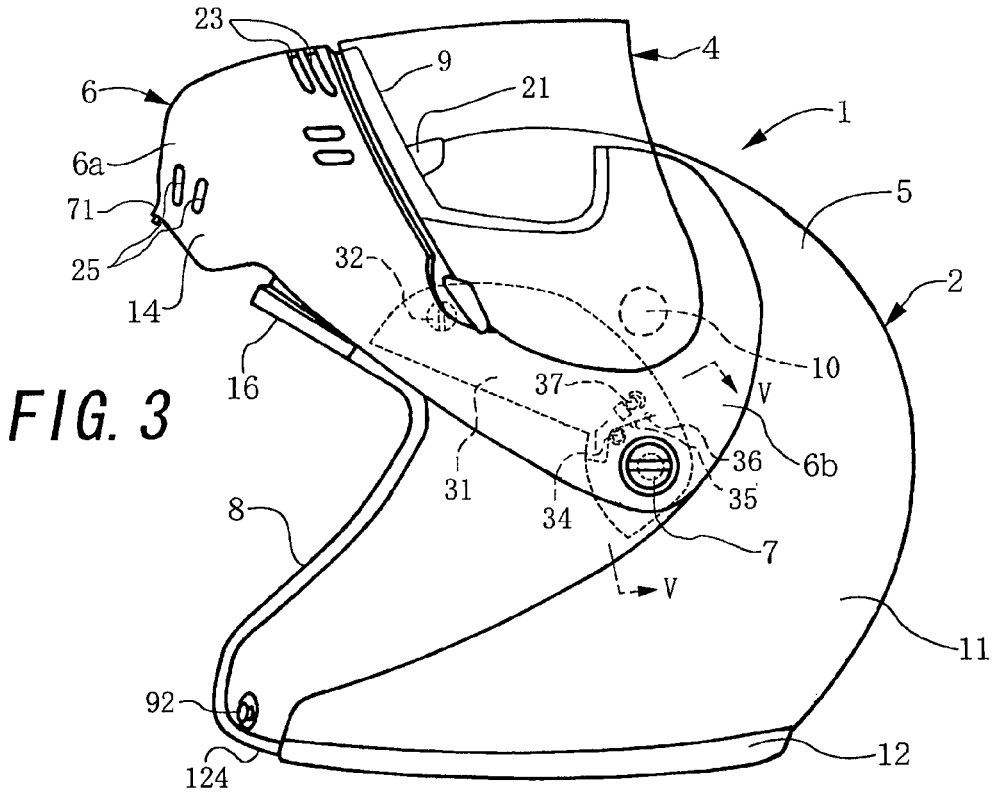
FIG. 3 is a right side view of the helmet shown in FIG. 1 as a whole with a subsidiary cap portion being moved upward.

As shown in FIGS. 1 to 3, a full-face-type helmet 1 serving also as a jet-type helmet comprises a full-face-type cap portion 2 serving also as a jet-type helmet which is to be worn on the head of a wearer such as a motorcycle rider, a shield plate 4 which can open and close a window opening 3 formed in the front surface of the cap portion 2 to oppose a portion between the forehead and chin of the wearer (that is, substantially the central portion of the face) and a pair of left and right chin straps (not shown) attaching to the inner side of the cap portion 2.

As has been conventionally known, the cap portion 2 shown in FIGS. 1 to 3 comprises a main cap portion 5 which can have substantially the same shape as that of the cap portion of a jet-type helmet, and a subsidiary cap portion 6 which is attached by a pair of left and right attaching screws 7 serving as an axial support means to the right and left sides of the main cap portion 5 to be reciprocally pivotal. Accordingly, a large notch extending upward from the lower end of the front surface of the main cap portion 5 forms a large window 8 in the main cap portion 5. As has been conventionally known, the subsidiary cap portion 6 comprises a chin cover **6*a* which is arcuate to extend forward, and a pair of left and right ears 6*b* which extend upward from the left and right ends of the chin cover 6*a* and are axially supported on the left and right sides of the cap portion 2 with the pair of left and right attaching screws 7 to be reciprocally pivotal. The subsidiary cap portion 6 also has a large window 9 formed by a large notch extending downward from the upper end of the front surface. When the subsidiary cap portion 6 pivots downward with respect to the main cap portion 5 to be located at the lower position (the state shown in FIGS. 1 and 2), it serves as a chin covering means for covering the wearer's chin to close the lower portion of the window 8. Hence, the upper portion of the window 8 defines the window opening 3. The window opening 3 is formed of a region surrounded by the rim of the window 8 of the main cap portion 2 and the rim of the window 9 of the subsidiary cap portion 6**.

As has been conventionally known, the shield plate 4 shown in FIGS. 1 to 3 can be made of a transparent or translucent hard material such as polycarbonate or another type of hard synthetic resin. A pair of left and right attaching screws 10 serving as an axial support means attach the shield plate 4 to the left and right sides of the subsidiary cap portion 6 to be reciprocally pivotal. When the subsidiary cap portion 6 is at the lower position and serves as the chin cover (the state shown in FIGS. 1 and 2), the shield plate 4 closes the window opening 3 when located at the backward position (that is, the lower position), and opens the window opening 3 when located at the forward position (that is, the upper position).

As has been conventionally known, the main cap portion 5 shown in FIGS. 1 to 3 can be made of a jet-type outer shell 11 which forms the circumferential wall of the main cap portion 5, a rim member 12 which has a substantially U-shaped section (note that the same has a substantially E-shaped section at the upper end of the window 8) or the like and attaches to the outer shell 11 throughout substantially the entire periphery of the end of the outer shell 11 by adhesion or the like, and a backing member (not shown) for the main cap portion which attaches to the inside of the outer shell 11 by adhesion or the like. As has been conventionally known, the outer shell 11 can be made of a composite material formed by lining the inner surface of the strong shell main body made of FRP or another hard synthetic resin, or the like with a flexible sheet such as nonwoven fabric. As has been known, the rim member 12 which has a substantially U-shaped section can be made of foamed vinyl chloride, synthetic rubber or another soft synthetic resin, or the like. As has been known, furthermore, the rim member 12 which has a substantially E-shaped section can be made of synthetic resin or another flexible elastic material.

As has been known, the backing member for the main cap portion 5 can be constituted by an impact absorbing liner for the main cap portion 5, a blockish inside pad for the main cap portion 5 and a backing cover for the main cap portion 5. The impact absorbing liner for the main cap portion 5 attaches to the inner surface of the outer shell 11 for the main cap portion 5 shown in FIGS. 1 to 3 by adhesion or the like. The blockish inside pad for the main cap portion 5 and the backing cover for the main cap portion 5 sequentially attach to the inner surface of the shock absorbing liner to substantially cover it. As has been known, the impact absorbing liner for the main cap portion 5 can be made of a material with appropriate rigidity and appropriate plasticity such as foamed polystyrene or another synthetic resin. As has been known, the blockish inside pad for the main cap portion 5 can be made of one or a plurality of elastic materials with high flexibility such as urethane foam or another synthetic resin, and porous nonwoven fabric which covers the inner and outer surfaces of the elastic material(s) to form a bag. As has been known, the backing cover for the main cap portion 5 can be made of a porous nonwoven fabric formed by laminating layers, consisting of an elastic material with high flexibility such as urethane foam or another synthetic resin or the like, on the surface opposing the impact absorbing liner for the main cap portion 5.

As has been known, the subsidiary cap portion 6 shown in FIGS. 1 to 3 can be made up of an outer shell 14 which forms the circumferential wall of the subsidiary cap portion 6, a rim member 16 which has a substantially E-shaped section or the like and fixes to part (i.e., the end portion of the window 9) of the end portion of the outer shell 14 by adhesion or the like, and a backing member (not shown) for the subsidiary cap portion 6 which is attached inside the outer shell 14 by adhesion or the like, in contact with the inner surface of the outer shell 14. As has been known, the outer shell 14 and the rim member 16 having the substantially E-shaped section can be made of the same materials as those described above concerning the outer shell 11 for the main cap portion 5 and the rim member 12 having the substantially E-shaped section.

As has been known, the backing member for the main cap portion 5 can be constituted by an impact absorbing liner for the subsidiary cap portion 6 which attaches to the inner surface of the outer shell 14 for the subsidiary cap portion 6 shown in FIGS. 1 to 3 by adhesion or the like, and a backing cover for the subsidiary cap portion 6 which attaches to the inner surface of the shock absorbing liner to substantially cover it. The impact absorbing liner for the subsidiary cap portion 6 can be made of a material with appropriate rigidity and appropriate plasticity such as foamed urethane rubber or another synthetic resin, or the like. The backing cover for the subsidiary cap portion 6 can be made of synthetic leather or another cloth made of a synthetic resin such as vinyl chloride resin or the like.

Figure 6:
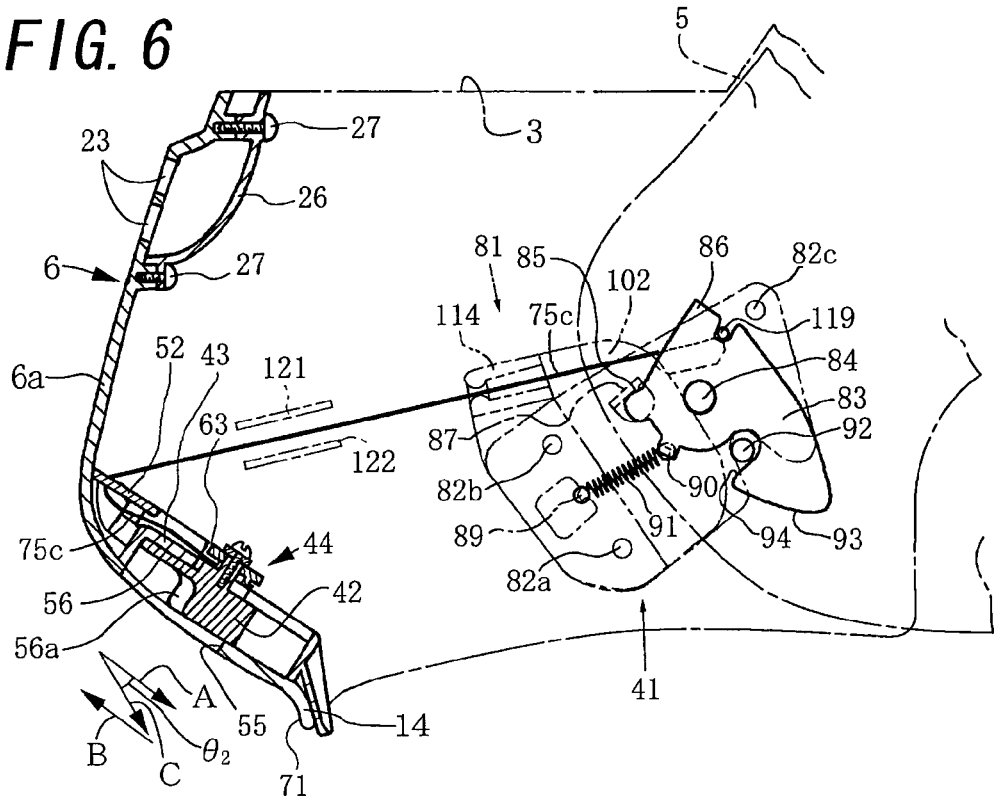
FIG. 6 is a partial centrally longitudinal sectional view of the helmet shown in FIG. 2 from which a backing member and rim member for the subsidiary cap portion are omitted to explain a right subsidiary cap portion locking mechanism.
Figure 7:
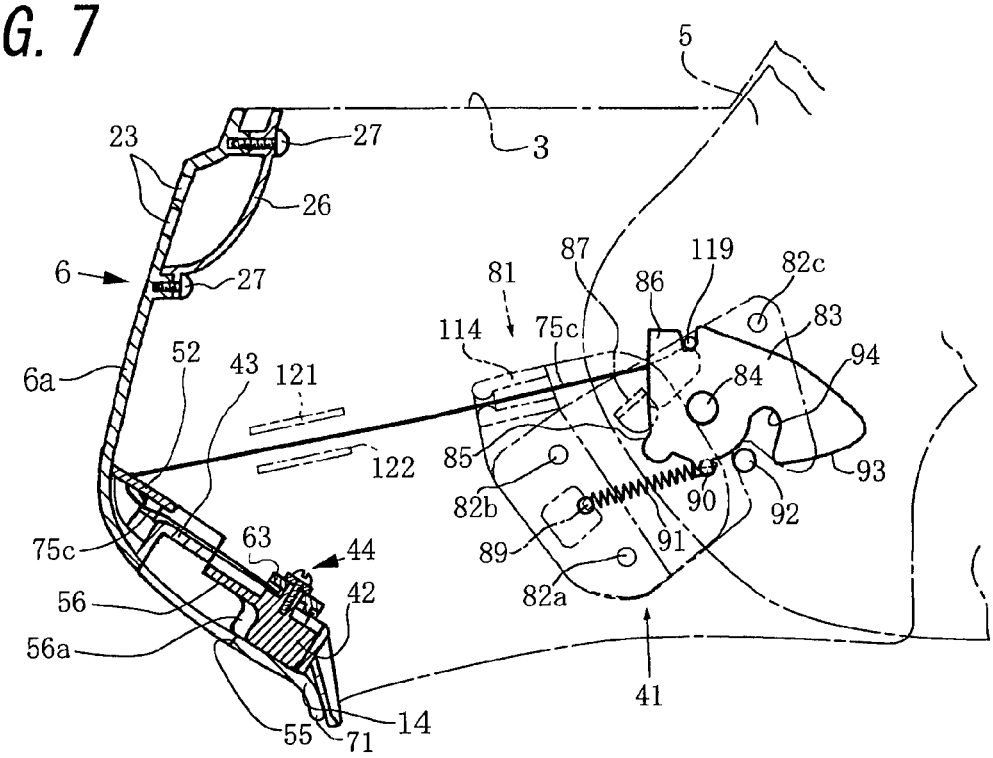
FIG. 7 is a view similar to FIG. 6 and shows a state wherein a release button is pressed.
Figure 8:
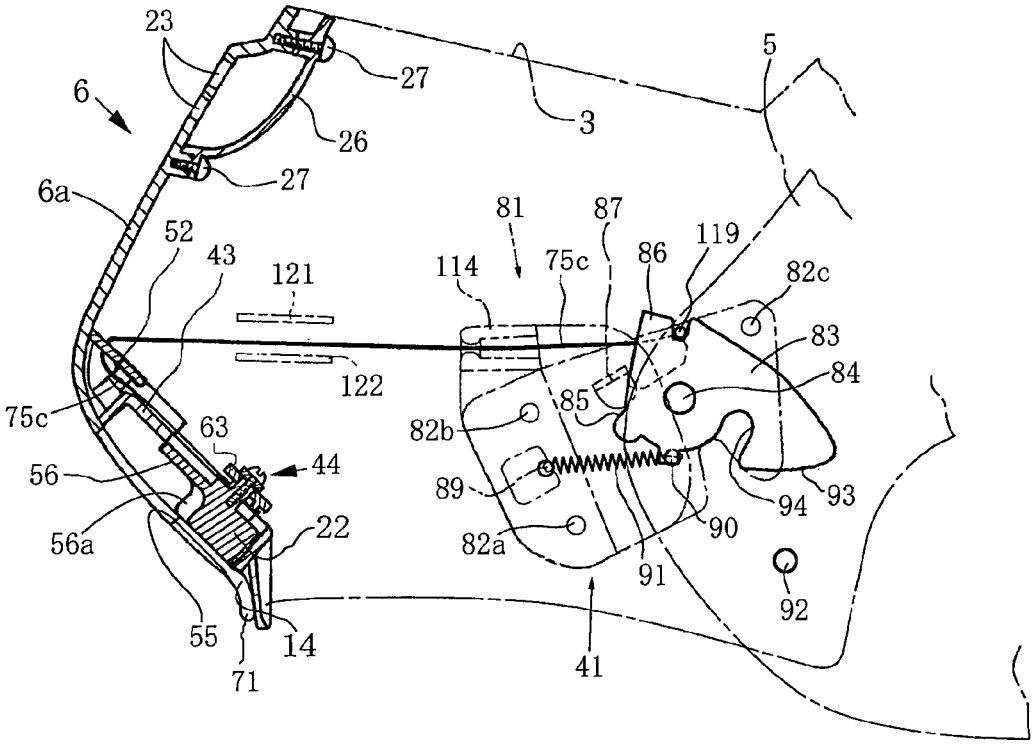
FIG. 8 is a view similar to FIG. 6 and shows a state wherein the subsidiary cap portion is slightly moved upward from the state shown in FIG. 7.

As shown in FIGS. 1 to 3, a ventilation aperture forming member 21 for the forehead attaches to the outer surface of the forehead portion of the main cap portion 5. The right portion of the outer surface of the subsidiary cap portion 6 is provided with a stopper 22 for regulating the backward position of the shield plate 4. Various types of ventilation apertures 23, 24, and 25 are formed in the chin cover 6*a* of the subsidiary cap portion 6. As shown in FIGS. 6 to 8, an air guide plate 26 attaches to the inner surface of the chin cover 6*a* with attaching screws 27 so as to oppose the ventilation apertures 23. Therefore, the front surface of the air guide plate 26 guides air flowing into the cap portion 2 through the ventilation apertures 23 to move upward in the cap portion 2 along the inner surface of the shield plate 4.

Figure 4:
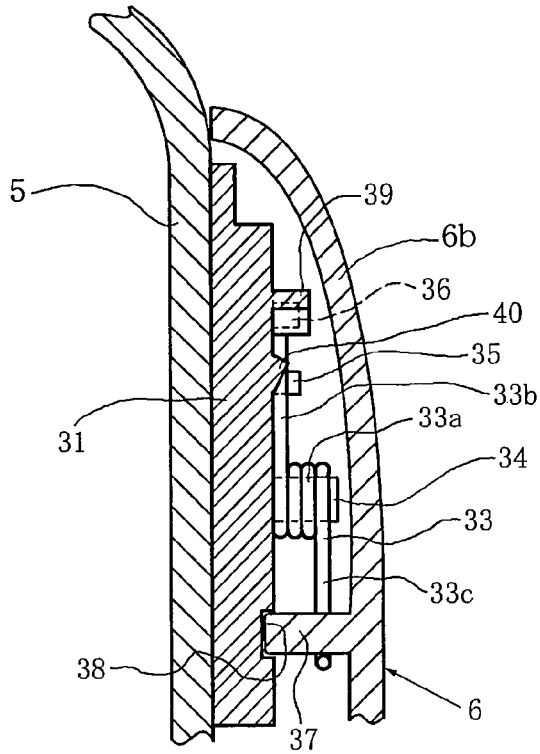
FIG. 4 is a sectional view taken along the line IV-IV of FIG. 2.
Figure 5:
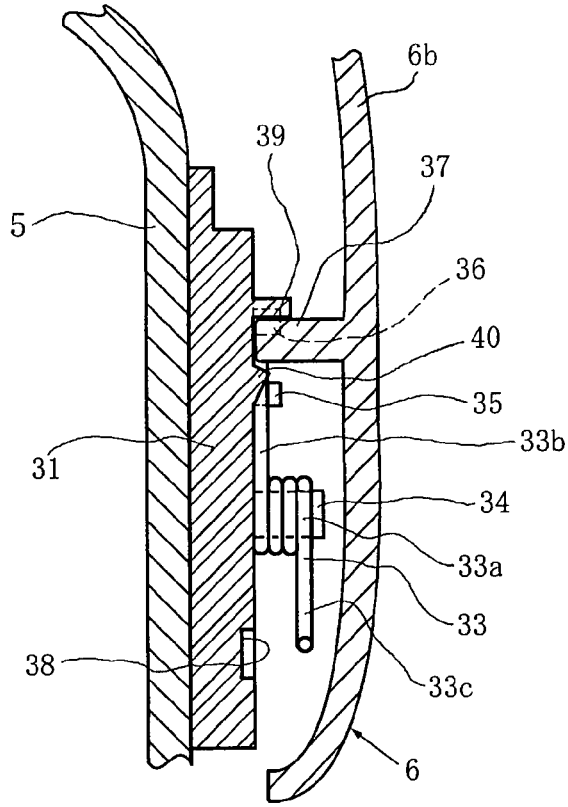
FIG. 5 is a sectional view taken along the line V-V of FIG. 3.

The main cap portion 5 is provided with a pair of left and right support plates 31 which serve to support the subsidiary cap portion 6 onto the main cap portion 5, as shown in FIGS. 2 and 3. Each of the pair of left and right support plate 31 can be an elongated plate-like member extending in substantially the back-and-forth direction, as shown in FIGS. 4 and 5, and can be made of an appropriate material such as a synthetic resin, e.g., polyacetal resin or ABS resin. The portion of the support plate 31 near the front end portion fixes to the outer shell 11 for the main cap portion 5 with attaching screws 32. The portion of the support plate 31 near the rear end portions fixes, together with the ears 6*b* of the subsidiary cap portion 6, to the outer shell 11 for the main cap portion 5 with the attaching screws (axial support means) 7.

As shown in FIGS. 4 and 5, a projection 34 to fit in a coil portion 33*a* provided to the central portion of a spring 33 serving as an elastic biasing means is formed on each support plate 31 by monolithic molding or the like. The spring 33 serves as a torsion coil spring, and further has first and second wire portions 33*b* and 33*c* extending from the coil portion 33*a* in substantially the opposite directions. A pair of spring catching projections 35 and 36 to engage with the first wire portion 33*b* are formed on the support plate 31 by monolithic molding or the like. The first wire portion 33*b* is inserted between the pair of spring catching projections 35 and 36.

As shown in FIGS. 4 and 5, a pair of left and right projections 37 serving as positioning means project from the inner surface of the outer shell 14 at the pair of right and left ears 6*b* of the subsidiary cap portion 6. The second wire portion 33*c* of the spring 33 is bent substantially arcuately. When the subsidiary cap portion 6 is at the lower position, as shown in FIGS. 2 and 4, the projections 37 press the arcuate second wire portions 33*c*, respectively. The respective support plates 31 have a pair of left and right recesses 38 serving as positioning means. When the subsidiary cap portion 6 is at the lower position, as shown in FIG. 2, the positioning projections 37 lightly engage or fit with the recesses 38, as shown in FIG. 4, to prohibit, with a comparatively small action force, the subsidiary cap portion 6 from moving. When the projections 37 engage or fit with the recesses 38, this engagement or fitting can entirely or partly reduce the upward biasing force of the subsidiary cap portion 6 generated by the springs 33. The springs 33 bias the subsidiary cap portion 6 upward (i.e., in the forward direction), so that the subsidiary cap portion 6 moves smoothly when the recess-projection engagement of the positioning means 37 and 38 and locking by a pair of left and right subsidiary cap portion locking mechanisms 41 are canceled.

Each support plate 31 has a substantially semicylindrical stopper projection 39 formed by monolithic molding or the like. When the subsidiary cap portion 6 is at the upper position, as shown in FIG. 3, the positioning projection 37 engages with the stopper projection 39, as shown in FIG. 5. The support plate 31 also has a stopper projection 40, having an inclined surface and formed by monolithic molding or the like, adjacent to the stopper projection 39. When the subsidiary cap portion 6 moves from the lower position to immediately before the upper position, the positioning projection 37 gradually rides over the inclined surface of the stopper projection 40. Accordingly, when the subsidiary cap portion 6 moves from the lower position to immediately before the upper position, the positioning projection 37 rides over the inclined surface 40 of the stopper projection 39 and thereafter passes it. As a result, as shown in FIG. 5, the stopper projection 39 completely prohibits the positioning projection 37 from moving further forward, and the stopper projection 40 prohibits the positioning projection 37 from moving backward, with a comparatively small action force (in other words, a temporary locking force).

2. Arrangement of Release Button and Holding Mechanism for the Same

The cap portion 2 incorporates the pair of left and right subsidiary cap portion locking mechanisms 41. Each of the pair of left and right subsidiary cap portion locking mechanisms 41 has a function of locking the subsidiary cap portion 6 at the lower position with the cap portion 2, as shown in FIGS. 6 and 8. A common release button 42 serving as an unlocking means or unlocking member unlocks the pair of subsidiary cap portion locking mechanisms 41.

Figure 9:
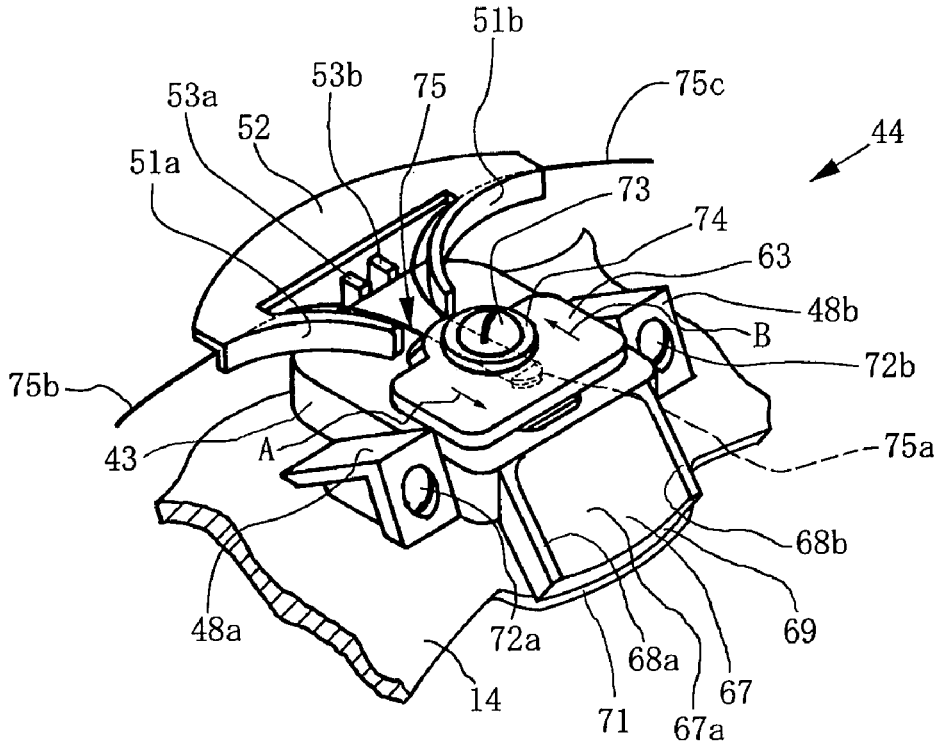
FIG. 9 is a perspective view of the release button and the holding mechanism for it shown in FIG. 6.
Figure 10:
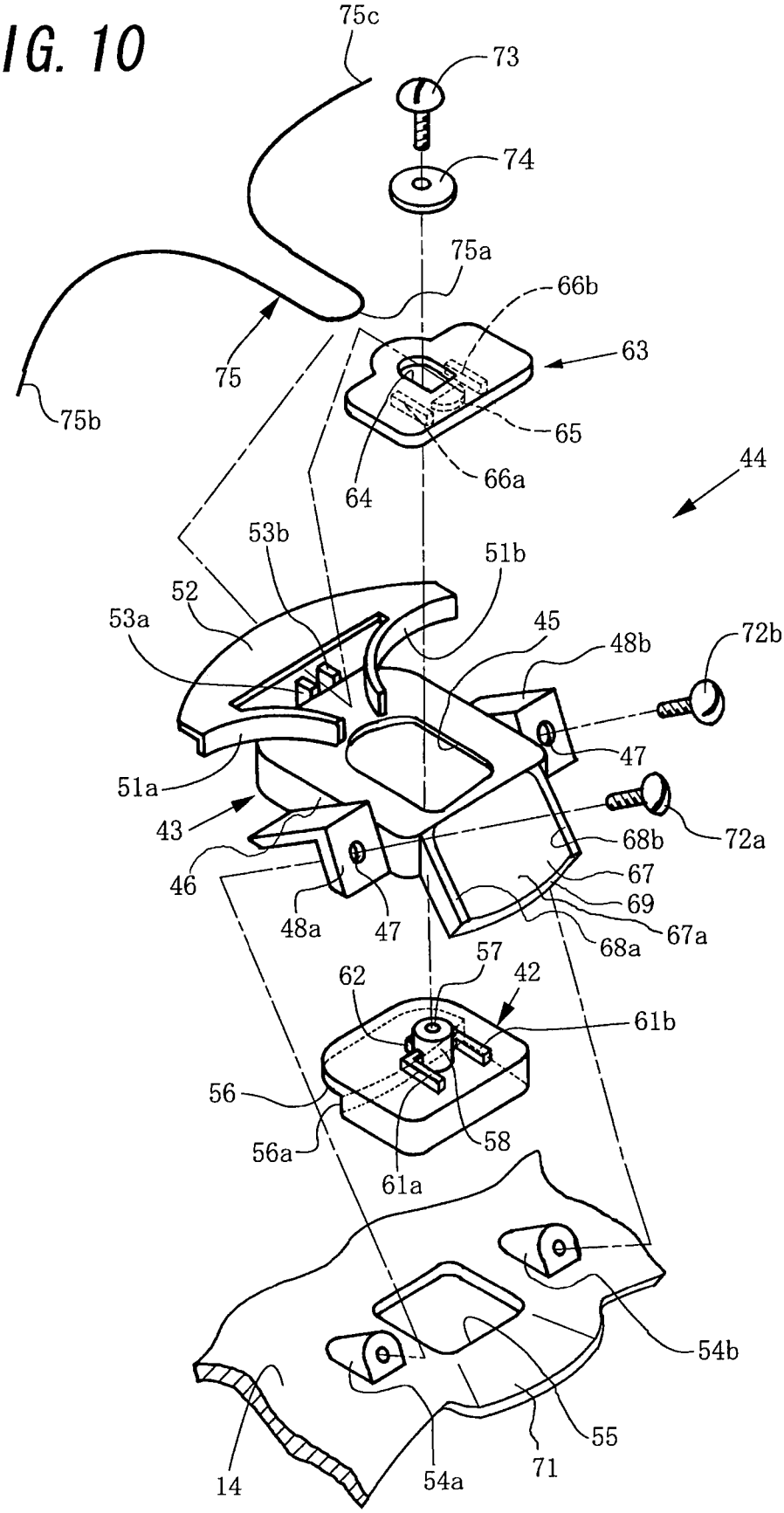
FIG. 10 is an exploded perspective view of the release button and the holding mechanism for it shown in FIG. 9.
Figure 11:
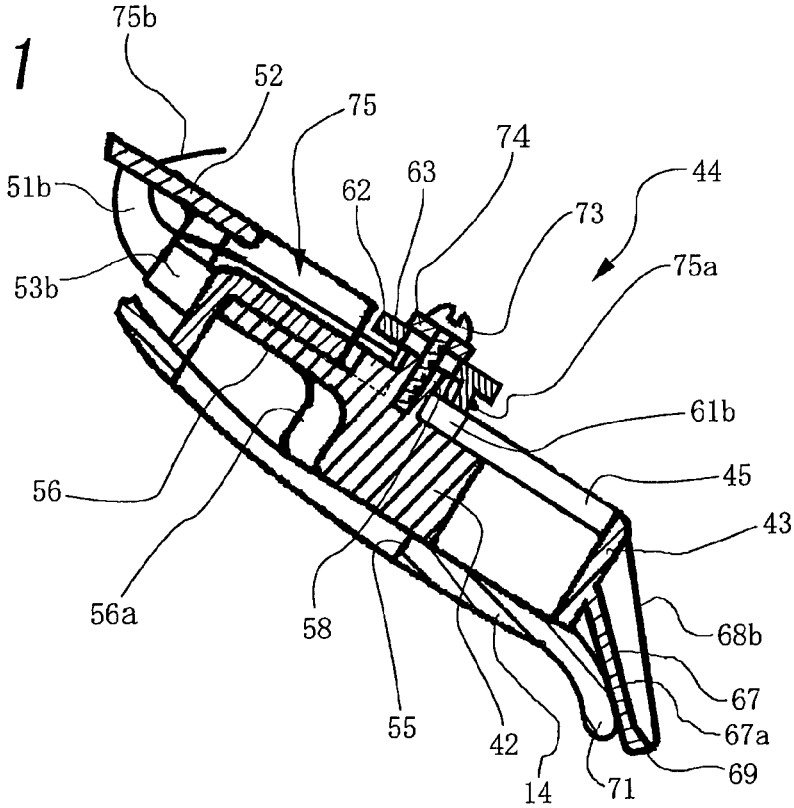
FIG. 11 is a centrally longitudinal sectional view of the release button and the holding mechanism for it shown in FIG. 10.

As shown in FIGS. 9 to 11, a button holding mechanism 44, serving as an operation member holding mechanism and comprising the outer shell 14 for the subsidiary cap portion 6 and a button holding member 43, holds the release button 42 at substantially the central portion of the subsidiary cap portion 6 (i.e., a portion opposing the distal end of the wearer's chin) to be linearly reciprocally slidable. The button holding member 43 can be made of an appropriate material such as a synthetic resin, e.g., polyacetal resin or ABS resin. The button holding member 43 comprises a member main body 46. The member main body 46 has an elongated hole 45 at substantially the central portion of its upper surface to extend in the back-and-forth direction, and has a substantially box's lid-like shape. A pair of left and right substantially V-shaped attached pieces 48*a* and 48*b* respectively having screw engaging holes 47 are formed on the left and right sides of the member main body 46 by monolithic molding or the like. A guide 52 having a pair of left and right arcuate pieces 51*a* and 51*b* is formed near the front end of the upper surface of the member main body 46 by monolithic molding or the like. A pair of left and right subsidiary guide plates 53*a* and 53*b* are formed on the front end face of the member main body 46 by monolithic molding or the like. A pair of left and right attaching bosses 54*a* and 54*b* to attach the button holding member 43 are formed at substantially the central portion of the outer shell 14 for the subsidiary cap portion 6 (i.e., a portion opposing the distal end of the wearer's chin) by monolithic molding or the like. A finger-inserting hole 55 is formed between the pair of attaching bosses 54*a* and 54*b*.

The release button 42 is formed of an appropriate material such as a synthetic resin, e.g., nylon 6 or ABS resin, to have a substantially blockish shape. As shown in FIGS. 10 and 11, a finger-inserting notched portion 56 is formed in one half of the lower surface of the release button 42. The notched portion 56 forms a press surface 56*a* (i.e., a surface substantially perpendicular to the aperture 55), used for pressing the release button 42 with a finger, in the release button 42. A columnar portion 58 having a screw hole 57 is formed on substantially the central portion of the upper surface of the release button 42 by monolithic molding or the like. A pair of left and right substantially L-shaped arms 61*a* and 61*b*, and a protrusion 62, all of which extend from the columnar portion 58, are also formed on the upper surface of the release button 42 by monolithic molding or the like.

A wire attaching member 63 serving as a wire body attaching member, which attaches and fixes to the common release button 42, is formed of an appropriate material such as a synthetic resin, e.g., nylon 6 or ABS resin, to have a substantially plate-like shape. An elongated hole 64 extending in the back-and-forth direction is formed at substantially the central portion of the wire attaching member 63, as shown in FIGS. 9 and 10. A substantially semicircular wire engaging portion 65 is formed on a surface of the wire attaching member 63 which is opposite to the outer shell 14 by monolithic molding or the like and near the rear end of the elongated hole 64. A pair of left and right projecting ridges 66*a* and 66*b* are formed on the left and right sides of the wire engaging portion 65 by monolithic molding or the like.

As shown in FIGS. 9 to 11, a finger putting plate 67 having an almost vertical finger putting surface 67*a* is formed on the rear end face of the member main body 46 of the button holding member 43 of the button holding mechanism 44 by monolithic molding or the like. The finger putting surface 67*a* has projection ridges 68*a*, 68*b* and 69 at its left and right side end portions and lower end portion, respectively. The projection ridges 68*a*, 68*b* and 69 form a substantially U-letter shape as a whole. Accordingly, when the wearer is to raise the subsidiary cap portion 6, if he places his finger (e.g., thumb) on the finger putting surface 67*a* of the finger putting plate 67, and thereafter raises the subsidiary cap portion 6 upward, this raising operation can be performed smoothly. The outer shell 14 is provided with an expansion 71 at substantially the central portion of the lower end of the chin cover 6*a* of the subsidiary cap portion 6 to slightly expand forward to conform to the shape of the finger putting plate 67.

As shown in FIG. 11, the button holding mechanism 44 constituted by the outer shell 14 for the subsidiary cap portion 6 and the button holding member 43 accommodates the release button 42 to be linearly reciprocally slidable. To accommodate the release button 42, first, the release button 42 is fitted in the button holding member 43 to be linearly reciprocally slidable. To fit the release button 42, the columnar portion 58, the pair of left and right L-shaped arms 61*a* and 61*b* and the protrusion 62 of the release button 42 are inserted in the elongated hole 45 of the button holding member 43. In this case, the pair of arms 61*a* and 61*b* are held to be linearly reciprocally slidable along the rim of the elongated hole 45. The left and right side surfaces and upper surface of the release button 42 are also held to be linearly reciprocally slidable along the left and right inner surfaces and lower surface of the member main body 46 of the button holding member 43.

Subsequently, the button holding member 43 which fits with the release button 42 is attached and fixed to the outer shell 14 for the subsidiary cap portion 6, as shown in FIG. 11. A pair of left and right attaching screws 72*a* and 72*b* inserted in the screw engaging holes 47 of the attached pieces 48*a* and 48*b* are screwed and fixed in the pair of left and right attaching bosses 54*a* and 54*b* of the outer shell 14 for the subsidiary cap portion 6, thereby attaching and fixing the button holding member 43. Accordingly, the release button 42 is reciprocally slidable in directions indicated by arrows A and B in FIGS. 6 and 9 with respect to the button holding member 43.

Subsequently, the wire attaching member 63 is attached and fixed to the release button 42, as shown in FIG. 9. An attaching screw 73 is inserted in the central hole of a washer 74 and the elongated hole 64 of the wire attaching member 63, and then screwed and fixed in the screw hole 57 of the columnar portion 58 of the release button 42, thereby attaching and fixing the wire attaching member 63. In the post-assembly state shown in FIGS. 9 and 11, the pair of left and right arms 61*a* and 61*b* of the release button (i.e., unlocking member) 42 fit between the pair of left and right projecting ridges 66*a* and 66*b* of the wire attaching member 63. In other words, a projection formed by the pair of left and right arms 61*a* and 61*b* (the intermediate portion of this projection, i.e., the portion between the pair of arms 61*a* and 61*b*, forms a notch) fits in a recess formed between the pair of left and right projecting ridges 66*a* and 66*b* through recess-projection fitting, to be linearly reciprocally slidable.

The wire engaging portion 65 of the wire attaching member 63 shown in FIG. 10 is inserted between the pair of left and right arms 61*a* and 61*b*. A U-shaped intermediate portion 75*a* of a tractive wire 75 is hooked on the wire engaging portion 65, and abuts against the right and left sides of the columnar portion 58 of the release button 42. Accordingly, the proximal portions of the pair of left and right arms 61*a* and 61*b* of the release button 42 and a surface of the wire attaching member 63 on the outer shell 14 side securely sandwich the intermediate portion 75*a* from the two sides. The pair of projecting ridges 66*a* and 66*b* of the wire attaching member 63 linearly reciprocally slide along the rim of the elongated hole 45.

When screwing the attaching screw 73 into the screw hole 57 slightly, the intermediate portion (in this case, substantially the central portion) 75*a* of the tractive wire 75, serving as a tractive flexible wire and made of a metal or the like, is hooked on the substantially arcuate portion of the wire engaging portion 65 of the wire attaching member 63 to substantially form a U-letter shape, and thereafter the attaching screw 73 is screwed into the screw hole 57 to fix the wire attaching member 63, as shown in FIG. 9. In this case, before screwing and fixing, the wire attaching member 63 is linearly moved back and forth by utilizing the elongated hole 64, so that the attaching position in the back-and-forth direction of the wire attaching member 63 with respect to the release button 42 can be adjusted. This adjusts the tautness of the tractive wire 75 to remove the unnecessary slack of the tractive wire 75.

3. Arrangement of Subsidiary Cap Portion

Locking Mechanism

The pair of left and right subsidiary cap portion locking mechanisms 41 commonly use the tractive wire 75 shown in FIG. 9. More specifically, the tractive wire 75 has a pair of left and right wire portions 75*b* and 75*c* respectively continuous to the two ends of the U-shaped intermediate portion 75*a*. The left subsidiary cap portion locking mechanism 41 uses the left wire portion (to be referred to as the "tractive wire" hereinafter) 75*b*. The right subsidiary cap portion locking mechanism 41 uses the right wire portion (to be referred to as the "tractive wire" hereinafter) 75*c*. Since the left and right subsidiary cap portion locking mechanisms 41 are symmetric, a description will be made concerning the right subsidiary cap portion locking mechanism 41 hereinafter with reference to FIGS. 6 to 8, 12 and 13, and a description on the left subsidiary cap portion locking mechanism 41 will be omitted where necessary.

As shown in FIGS. 6 to 8, 12 and 13, the right subsidiary cap portion locking mechanism 41 comprises an attaching base 81, lock lever 83 and tractive coil spring (i.e., elastic biasing means) 91. The attaching base 81 comprises a main attaching base 101 and subsidiary attaching base 102, each of which can be made of an appropriate material such as a metal like stainless steel, or a synthetic resin like ABS resin. The main attaching base 101 and subsidiary attaching base 102 may be made of the same material. Note that the main attaching base 101 is preferably made of a metal, and the subsidiary attaching base 102 is preferably made of a synthetic resin.

Figure 13:
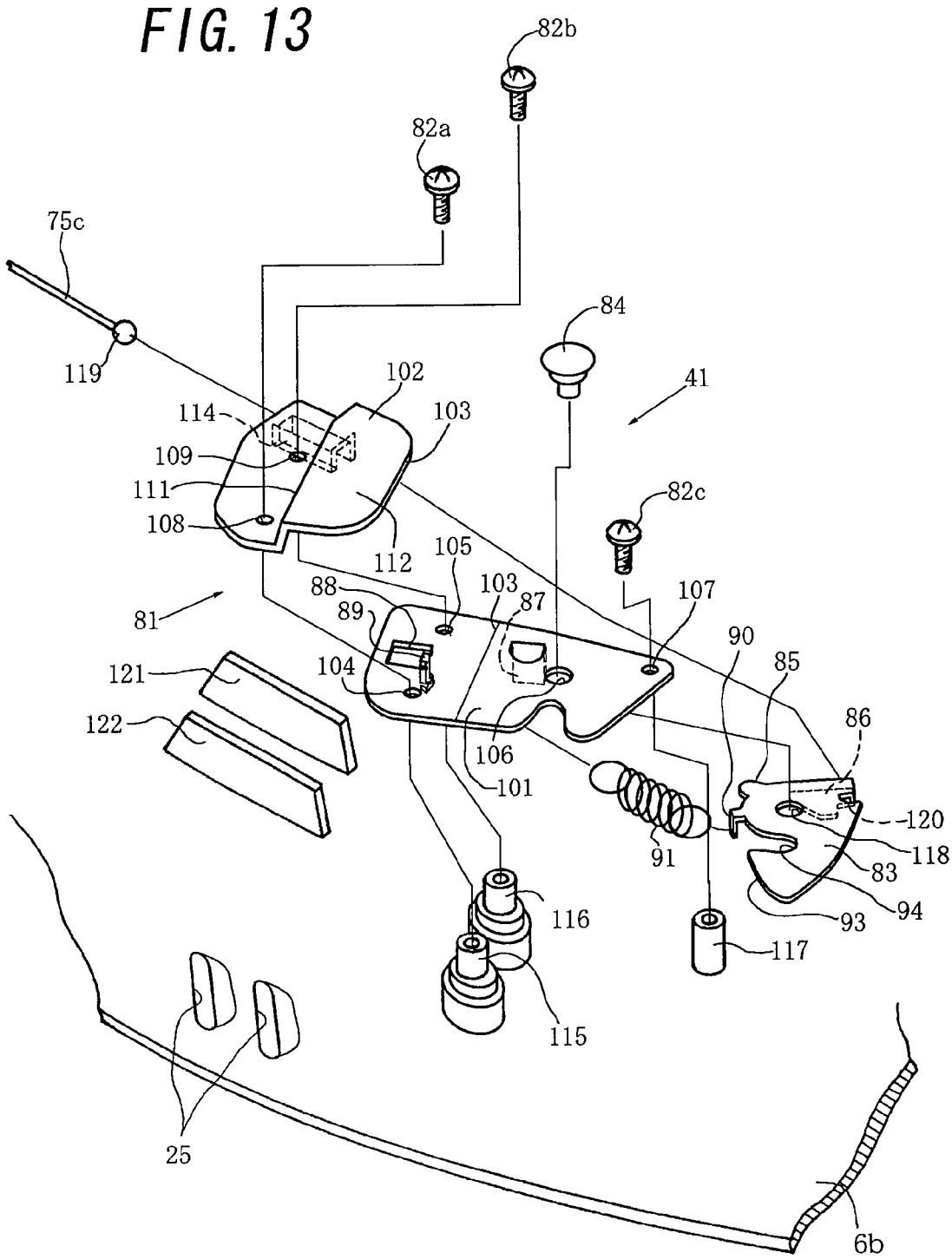
FIG. 13 is an exploded perspective view of the right subsidiary cap portion locking mechanism shown in FIG. 12.

As shown in FIG. 13, the main attaching base 101 may form a substantially flat plate (in the case of the embodiment shown in FIG. 13, a portion of the main attaching base 101 on the front side of a portion near a substantially central virtual line 103 rises slightly to incline toward the inner surface (i.e., toward the left side surface)). The main attaching base 101 has boss inserting holes 104 and 105, rivet inserting hole 106, screw inserting hole 107 and opening 88 (to be described later). The subsidiary attaching base 102 has screw inserting holes 108 and 109. The subsidiary attaching base 102 has a step 111 near a substantially central line. A half portion 112 of the subsidiary attaching base 102 which is on the rear side of the step 111 rises toward a side opposite to the main attaching base 101. The subsidiary attaching base 102 integrally has a substantially U-shaped wire support 114, formed by projecting a pair of ears, at its front end.

As shown in FIG. 13, the inner surface of the ear 6*b* of the subsidiary cap portion 6 is provided with attaching bosses 115, 116 and 117. Attaching screws 82*a* and 82*b* are sequentially inserted in the screw inserting holes 108 and 109 of the subsidiary attaching base 102 and the screw inserting holes 104 and 105 of the main attaching base 101, and then screwed into the screw holes or self-tap holes of the attaching bosses 115 and 116. Accordingly, the attaching screws 82*a* and 82*b* integrally connect the subsidiary attaching base 102 to the main attaching base 101, so the subsidiary attaching base 102 constitutes the attaching base 81 together with the main attaching base 101. An attaching screw 82*c* is inserted in the screw inserting hole 107 of the main attaching base 101 and then screwed into the screw hole or self-tap hole of the attaching boss 117. A rivet (i.e., axial support means) 84 is sequentially inserted in the rivet inserting hole 106 of the main attaching base 101 and a rivet inserting hole 118 formed in the lock lever 83, and then its distal end portion is pressed down on the outer surface of the lock lever 83. Hence, the rivet 84 pivotally attaches the lock lever 83 to the main attaching base 101.

Figure 12:
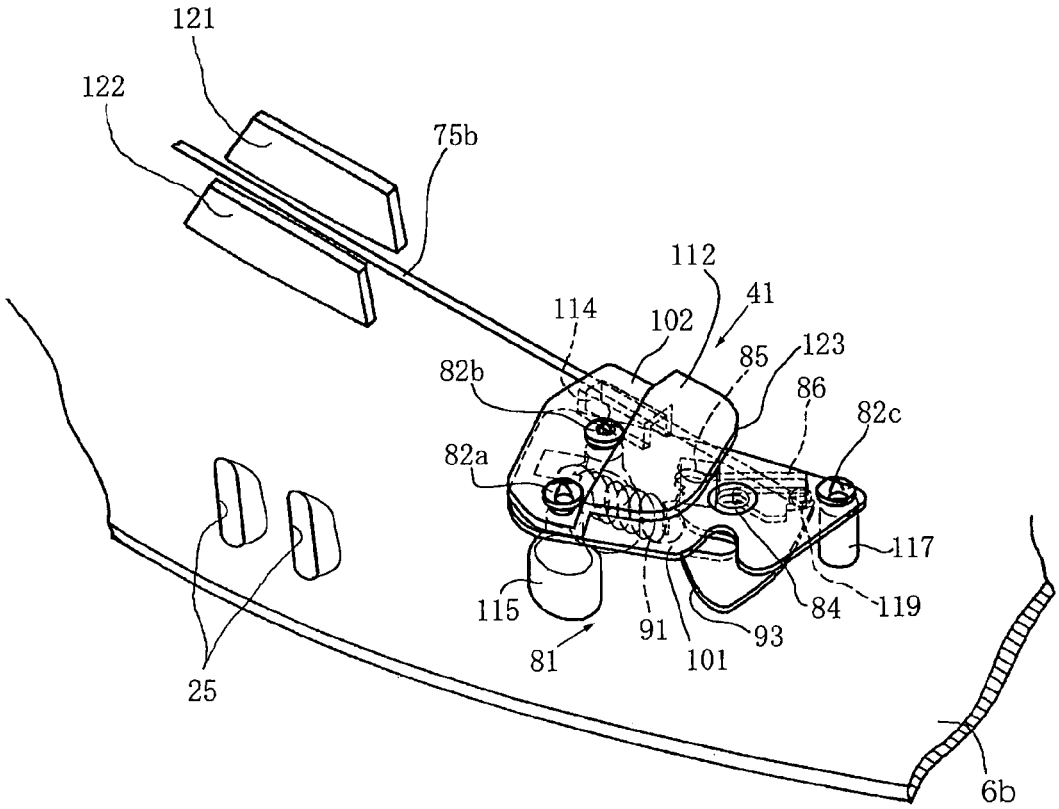
FIG. 12 is a perspective view of the right subsidiary cap portion locking mechanism of the helmet shown in FIG. 6.

While the subsidiary attaching base 102 attaches to the subsidiary cap portion 6 as described above, the substantially U-shaped wire support 114 of the subsidiary attaching base 102 shown in FIG. 12 practically abuts against the inner surface of the ear 6*b* of the subsidiary cap portion 6. Thus, the wire support 114 and the inner surface of the ear 6*b* form an substantially closed-loop wire inserting hole. Hence, prior to attaching the subsidiary attaching base 102 to the main attaching base 101 with the attaching screws 82*a* and 82*b*, the tractive wire 75*c* is preferably inserted in the substantially U-shaped wire support 114.

While the subsidiary attaching base 102 attaches to the subsidiary cap portion 6 as described above, the main attaching base 101 and the rear portion 112 of the subsidiary attaching base 102 define a gap 123, as shown in FIG. 12. Accordingly, the subsidiary attaching base 102 serves as a gap defining member as well. When the subsidiary cap portion 6 is at the lower position shown in FIGS. 6 and 7 and at the intermediate position shown in FIG. 8 which is slightly above the lower position, a portion of the outer shell 11 of the main cap portion 5 near its lower end is relatively inserted in the gap 123, as shown in FIGS. 6 to 8. This adjusts the lock lever 83 of the subsidiary cap portion 6 with respect to the portion of the outer shell 11 of the main cap portion 5 near its lower end (also the lock pins 92) relative to each other to a certain degree in the direction of thickness of the outer shell 11. This can prevent the lock pin 92 from accidentally disengaging relatively from the locking recess 94 of the lock lever 83, or from accidentally, relatively separating from an abutting portion 93 of the lock lever 83, to a certain degree. A cover member (not shown) for covering the outer surface and, where necessary, the inner surface as well, of the portion of the outer shell 11 near its lower end may be provided, and the lock pin 92 may be fixed to the cover member. This cover member can be made of the same material as that described above concerning the button holding member 43.

The inner surface of the outer shell 14 of the main cap portion 5 is provided with the pair of left and right subsidiary attaching bases 102 on the left and right sides of the chin cover 6*a* of the subsidiary cap portion 6. Accordingly, the gap 123 is formed on each of the right and left sides to constitute a pair. A pair of left and right portions of the outer shell 11, near the lower end, of the main cap portion 5 are inserted in the pair of left and right gaps 123, respectively. This insertion amount is maximum when the subsidiary cap portion 6 is at the lower position shown in FIGS. 6 and 7, and decreases gradually as the subsidiary cap portion 6 moves forward from the lower position shown in FIGS. 6 and 7 to the intermediate position shown in FIG. 8 which is slightly above the lower position. When the subsidiary cap portion 6 further moves upward from the intermediate position shown in FIG. 8, the pair of left and right portions of the outer shell 11 near its lower end completely disengage from the pair of left and right gaps 123. When the subsidiary cap portion 6 moves downward, operation precisely opposite to that described above takes place.

Spherical bodies 119 made of a metal or the like fix to the free ends of the pair of left and right tractive wires 75*b* and 75*c*, as shown in FIGS. 12 and 13. A wire attached portion 86 formed of a substantially L-shaped upright portion is integrally formed on the lock lever 83 to slightly rise from the outer surface of the lock lever 83. An engaging notch 120 having a substantially semicircular shape or the like, is formed in the wire attached portion 86. Note that the substantially L-shaped wire attached portion 86 only slightly rises from the main body portion of the lock lever 83, and merely a comparatively small gap is formed between the wire attached portion 86 and the main body portion of the lock lever 83. The distal end of the tractive wire 75*c* is inserted in the wire support 114, as described above, and then in this small gap. Subsequently, the spherical body 119 is fitted in the engaging notch 120 of the wire attached portion 86, thereby fixing the free end of the tractive wire 75*c* to the lock lever 83. Therefore, the pair of left and right tractive wires 75*b* and 75*c* extend substantially linearly between the arcuate pieces 51*a* and 51*b* of the guide 52 of the button holding member 43 and the wire support 114 of the subsidiary attaching base 102.

On the inner surface of the outer shell 14 of the subsidiary cap portion 6, a pair of upper and lower projecting ridges 121 and 122 extending substantially horizontally are formed on each of the left and right sides of the chin cover 6*a* of the subsidiary cap portion 6, as shown in FIGS. 6 to 8 and 13. The substantially intermediate portion of either one of the tractive wires 75*b* and 75*c* is interposed between the pair of upper and lower projecting ridges 121 and 122 so that it is positioned to a certain degree.

According to the above arrangement, the attaching screws 82*a* and 82*b* attach and fix the main attaching base 101 onto the inner surface of the left side ear 6*b* of the subsidiary cap portion 6, as shown in FIGS. 6 to 8, 12 and 13. The rivet 84 axially supports the lock lever 83, serving as the movable locking means or movable locking member, onto the main attaching base 101 to be reciprocally pivotal. One end of the lock lever 83 is integrally formed with a stopped portion 85 and the wire attached portion 86 described above. The stopped portion 85 is formed of a substantially flat plate-like upright portion standing on the inner surface of the lock lever 83. When the stopped portion 85 abuts against a protrusion 87 provided to the main attaching base 101, the main attaching base 101 regulates the backward pivot position of the lock lever 83.

The main attaching base 101 is integrally formed with a spring catching portion 89 which is formed of a flat plate-like upright portion standing on the outer surface of the main attaching base 101. The main attaching base 101 also has the opening 88 necessary to form the spring catching portion 89. The lock lever 83 is integrally formed with a spring catching portion 90 which is formed of a flat plate-like upright portion standing on the outer surface of the lock lever 83. A tractive coil spring 91 is interposed between the spring catching portion 89 of the main attaching base 101 and the spring catching portion 90 of the lock lever 83. Thus, the coil spring 91 biases the lock lever 83 to be pivotal clockwise in FIG. 6 about the attaching screw 84 as the center. Since the lock lever 83 is biased to be pivotal clockwise in FIG. 6, the tractive wire 75*b* tractively biases the release button 42 in the backward direction indicated by an arrow B in FIGS. 6 and 9.

The release button 42 can move forward in the direction indicated by an arrow A in FIGS. 6 and 9 against the tractive biasing force of the tractive wire 75*b*. The forward direction A of the release button 42 forms an acute angle $\theta_2$ with respect to the downward moving direction (i.e., a backward pivot direction about the attaching screw 7 as the fulcrum and, more particularly, the backward direction, immediately before the backward movement to the backward position, of the center of the press surface 56*a* of the release button 42) C of the subsidiary cap portion 6, as shown in FIG. 6. In the embodiment shown in FIG. 6, the angle $\theta_2$ is about 25°. According to the present invention, preferably, from the viewpoint of practicability, this angle is generally 0° to 60°, and more preferably 0° to 45°. The forward direction A of the release button 42 is inward (i.e., backward in FIG. 6) from the downward moving direction C of the subsidiary cap portion 6. However, this direction A need not be inward but can be outward. In order to move the release button 42 forward and move the subsidiary cap portion 6 upward very smoothly, the forward direction A of the release button 42 is preferably inward from the downward moving direction C of the subsidiary cap portion 6. In this case, the acute angle $\theta_2$ is particularly preferably 5° to 45°.

As shown in FIG. 3, a pair of left and right lock pins 92 serving as a stationary locking means or stationary locking member project near the lower end of the outer surface of the outer shell 11 of the main cap portion 5. The lock levers 83 of the left and right subsidiary cap portion locking mechanisms 41 selectively engage with the pair of left and right lock pins 92 depending on their pivot positions. Each lock lever 83 has the abutting portion 93 on the other end, against which the corresponding lock pin 92 abuts. A locking recess 94 to engage with the lock pin 92 is formed adjacent to the abutting portion 93.

The respective portions (i.e., the main attaching bases 101, subsidiary attaching bases 102, coil springs 91, lock levers 83, attaching screws 82*a*, 82*b* and 82*c*, rivets 84 and the like) of the locking mechanisms 41, the release button 42, the button holding mechanism 44 (i.e., the button holding member 43, attaching bosses 54*a* and 54*b* and the like), the wire attaching member 63, the washer 74, the attaching screws 72*a*, 72*b* and 73, the tractive wire 75 and the like are arranged along the inner surface of the outer shell 14 for the subsidiary cap portion 6. Hence, recesses and ridge grooves for accommodating these portions are formed in that surface of the impact absorbing liner for the subsidiary cap portion 6 which opposes the outer shell 14.

4. How to Use Helmet

Assume that the wearer wishes to use the full-face-type helmet 1, serving also as the jet-type helmet and having the above arrangement, as the full-face-type helmet. If the subsidiary cap portion 6 is at the upper position, as shown in FIGS. 3 and 5, the wearer may put his hand on the outer surface of the subsidiary cap portion 6 and/or shield plate 4 and pull the subsidiary cap portion 6 downward against the temporary locking force of the pair of left and right stopper projections 40 and the biasing force of the pair of left and right springs 33. This pull-down operation pivots the subsidiary cap portion 6 downward and backward about the attaching screws 7 as the fulcrum, thereby bringing it to the lower position shown in FIGS. 1 and 2. In this case, as shown in FIG. 7, the abutting portions 93 of the lock levers 83 provided to the subsidiary cap portion 6 abut against the lock pins 92. Then, the lock pins 92 press the lock levers 83 to pivot slightly forward counterclockwise in FIG. 7 about the attaching screws 84 as the fulcrum against the biasing force of the coil springs 91. The lock pins 92 thus ride over the abutting portions 93 of the lock levers 83, as shown in FIG. 6, to engage with the corresponding locking recesses 94. As the pair of left and right subsidiary cap portion locking mechanisms 41 securely lock the subsidiary cap portion 6 to the main cap portion 5, the cap portion 2 serves as the full-face-type helmet shown in FIGS. 1, 2, 4 and 6.

Assume that the wearer wishes to use the full-face-type helmet 1 shown in FIGS. 1, 2, 4 and 6, serving also as the jet-type helmet and having the above arrangement, as the jet-type helmet shown in FIGS. 3 and 5. In the state shown in FIG. 6, the wearer inserts his finger (e.g., index and/or middle finger) in the notched portion 56 of the release button 42 through the aperture 55 located at substantially the central portion of the outer surface of the chin cover 6*a* of the subsidiary cap portion 6. The wearer presses the press surface 56*a* of the release button 42 downward with this finger in the forward direction, indicated by the arrow A in FIG. 6, against the biasing force of the coil springs 91. In this case, since the press surface 56*a* is substantially perpendicular to the forward direction A of the release button 42, the direction of the force applied from the finger to the release button 42 substantially coincides with the forward direction A.

Since the release button 42 moves forward in the direction indicated by the arrow A in FIGS. 6 and 9 against the biasing force of the coil springs 91, the release button 42 pulls the tractive wires 75*b* and 75*c* to slide along the arcuate pieces 51*a* and 51*b* of the button holding member 43 during the traction. Therefore, the lock levers 83 in the state shown in FIG. 6 pivot forward counterclockwise about the attaching screws 84 as the fulcrum, and are set in the state shown in FIG. 7. This unlocks the subsidiary cap portion 6 which has been locked with respect to the main cap portion 5 by the locking mechanisms 41. Accordingly, if the wearer simultaneously places his finger (e.g., the thumb) on substantially the central portion of the lower end of the subsidiary cap portion 6 (e.g., grabs the subsidiary cap portion 6 from the upper and lower sides with his index finger and/or middle finger inserted in the notched portion 56 and his thumb placed on substantially the central portion of the lower end of the subsidiary cap portion 6), and raises the subsidiary cap portion 6 upward, the subsidiary cap portion 6 pivots upward about the attaching screws 7 as the fulcrum. The subsidiary cap portion 6 is thus set in the state shown in FIGS. 3 and 5 through the state shown in FIG. 8. Thus, the cap portion 2 serves as the jet-type helmet.

When the cap portion 2 serves as the full-face-type helmet, as described above, the projections 37 engage or fit with the recesses 38, as shown in FIG. 4. This engagement or fitting can reduce the upward biasing force of the subsidiary cap portion 6, generated by the springs 33, entirely or partly. Therefore, not only the pair of left and right subsidiary cap portion locking mechanisms 41 lock the subsidiary cap portion 6, located at the lower position, at the lower position, but also the recess-projection engagement by the positioning means 37 and 38 lightly holds, with a comparatively small action force, the subsidiary cap portion 6 at the lower position to prohibit it from moving in the forward direction. The springs 33 bias the subsidiary cap portion 6 in the upward direction (i.e., the forward direction) so the subsidiary cap portion 6 moves upward smoothly when the recess-projection engagement is canceled. The springs 33 also bias the subsidiary cap portion 6 clockwise in FIGS. 2 and 6 with respect to the main cap portion 5 about the attaching screws (axial support means) 7 as the fulcrum. This prevents the lock pins 92 from accidentally disengaging from the locking recesses 94 of the lock levers 83, due to the vibration of the helmet 1 or the like, to a certain degree.

Furthermore, in the full-face-type helmet 1 serving also as the jet-type helmet shown in FIGS. 1 to 13, while the wearer uses the helmet 1 with the subsidiary cap portion 6 being pulled down to the lower position, even if a comparatively large impact acts on the helmet 1 in a direction to move the subsidiary cap portion 6 upward, the accidental upward movement of the subsidiary cap portion 6, despite that the wearer does not press the release button 42 for unlocking, hardly occurs. The reason for this will be described below with reference to FIG. 14 which is identical with FIG. 15 showing a conventional helmet.

Figure 14:
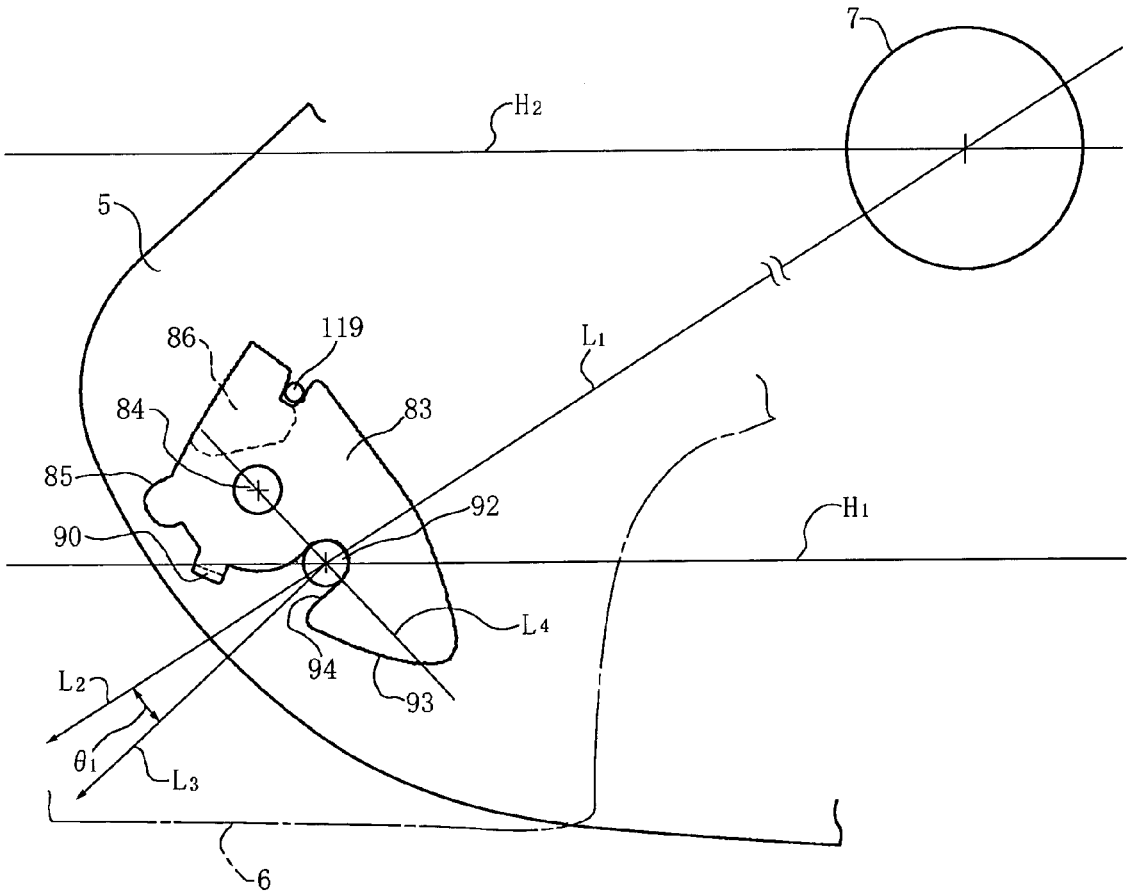
FIG. 14 is a partial centrally longitudinal sectional view, seen from the side direction of the cap portion, which schematically shows the mutual positional relationship among the attaching screw shown in FIG. 2 and the lock lever and lock pin shown in FIG. 6.
Figure 15:
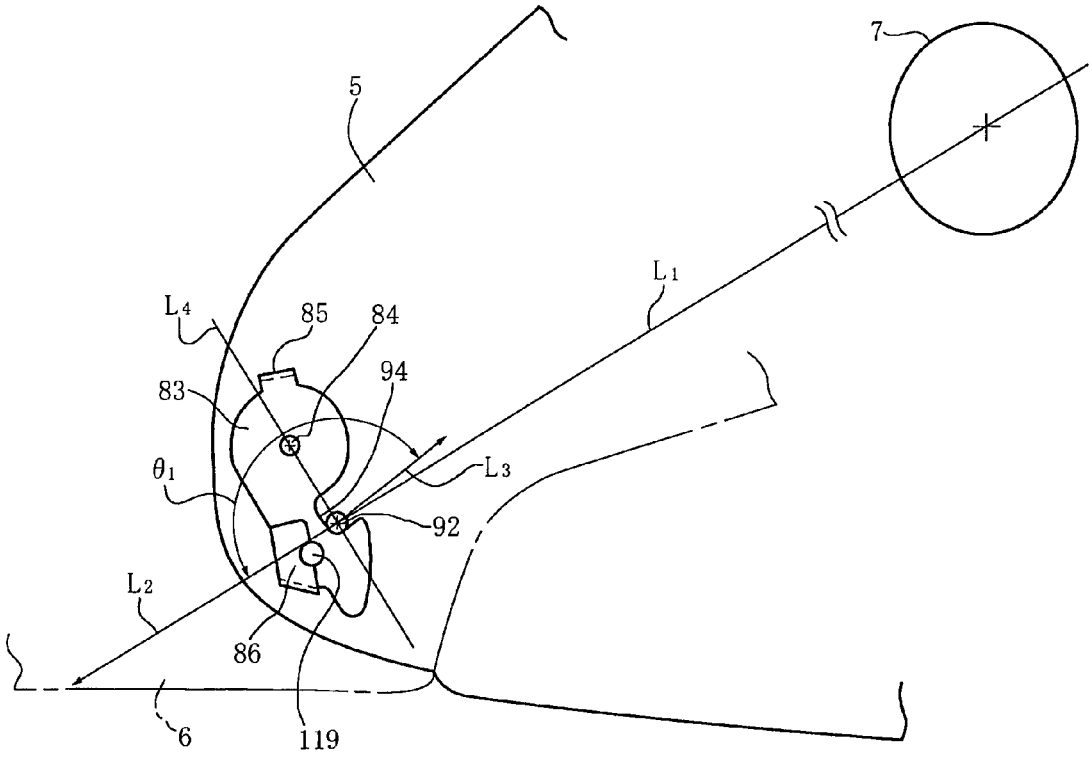
FIG. 15 is a centrally longitudinal sectional view, similar to FIG. 14, of a conventional full-face-type helmet serving also as a jet-type helmet.

FIG. 14 shows the mutual positional relationship, seen from the side direction (that is, the side), among the attaching screw 7, lock lever 83 and lock pin 92 of the cap portion 2 of the helmet 1 shown in FIGS. 1 to 13 with a lower end opening 124 of the helmet 1 being substantially horizontal. In FIG. 14 which shows the helmet 1 of FIGS. 1 to 13, reference symbol $L_1$ denotes the first straight line extending from the center of the attaching screw 7 to the center of the lock pin 92. The intermediate portion of the first straight line $L_1$ is omitted. Reference symbol $L_2$ denotes the second straight line obtained by extending the first straight line $L_1$ from the center of the lock pin 92 in a direction opposite to the center of the attaching screw 7 so as to be identical with the first straight line $L_1$. Reference symbol $L_3$ denotes the third straight line extending from the center of the lock pin 92 in a direction along which the lock pin 92 starts to relatively disengage from the locking recess 94 upon forward pivot motion (that is, clockwise pivot motion in FIG. 14) of the lock lever 83 about the center of the rivet (axial support means) 84 as the pivot fulcrum. The third straight line $L_3$ is substantially perpendicular to a fourth straight line $L_4$ which connects the center of the rivet 84 to the center of the lock pin 92 and faces on substantially the same side as the second straight line $L_2$. Hence, an angle $\theta_1$ that the third straight line $L_3$ forms with the second straight line $L_2$ is substantially equal to or near 0° (more specifically, a downward angle of about 10°).

In FIG. 14 which shows the helmet 1 of FIGS. 1 to 13, the angle $\theta_1$ that the second straight line $L_2$ forms with the third straight line $L_3$ is substantially equal to or near 0°. Hence, the pivot direction along which the subsidiary cap portion 6 starts to move upward and the pivot direction along which the lock lever 83 starts to pivot forward about the rivet 84 as the fulcrum so as to relatively disengage the lock pin 92 from the locking recess 94 face substantially the opposite sides. Therefore, assume that a comparatively large impact that is to pivot the subsidiary cap portion 6 forward from the backward position shown in FIG. 14 acts on the helmet. Even if the lock lever 83, rivet 84, lock pin 92 and the like deforms elastically or in other manners, the lock pin 92 hardly accidentally disengages relatively from the locking recess 94 of the lock lever 83. Thus, even if the springs 33 bias the subsidiary cap portion 6 in the forward pivot direction, the subsidiary cap portion 6 will hardly pivot forward about the attaching screws 7 as the fulcrum undesirably to accidentally move upward.

In the helmet 1 shown in FIGS. 1 to 14, the angle $\theta_1$ is substantially equal to or near 0°. While the subsidiary cap portion 6 is in the backward state as shown in FIG. 14, the pivot fulcrum (i.e., the axis of the rivet 84) of the lock lever 83 is located between a first horizontal line $H_1$ extending through the center of the lock pin 92 and a second horizontal line $H_2$ extending through the center of the attaching screw 7. When the wearer presses the release button 42 to relatively disengage the lock lever 83 from the lock pin 92, even if the forward pivot amount (i.e., the angle of the forward pivot motion) of the lock lever 83 is very small, as shown in FIGS. 7 and 8, the lock lever 83 will not come into contact again with the lock pin 92 that has relatively disengaged from the lock lever 83, but can smoothly move upward as the subsidiary cap portion 6 accompanies it.

Having described a specific preferred embodiment of this invention with reference to the accompanying drawings, it is to be understood that the invention is not limited to that precise embodiment, and that various changes and modifications may be effected therein by one skilled in the art without departing from the scope or spirit of the invention as defined in the appended claims.

For example, in the above embodiment as shown in FIG. 14, the third straight line $L_3$ is directed more downward than the second straight line $L_2$ by the angle $\theta_1$. Alternatively, the third straight line $L_3$ may be directed more upward than the second straight line $L_2$ by the angle $\theta_1$.

In the above embodiment, the pair of left and right subsidiary cap portion locking mechanisms 41 are provided. However, the number of subsidiary cap portion locking mechanisms 41 is not always limited to two, but can be one, or three or more where necessary.

In the above embodiment, the direction perpendicular to the press surface 56*a* of the release button 42 substantially coincides with the forward direction A of the release button 42. However, if these two directions do not coincide with each other more or less, no problem arises. In this case as well, an acute angle $\theta_2$ that the direction perpendicular to the press surface 56*a* of the release button 42 forms with the downward direction C of the subsidiary cap portion 6 may have the same angular range as that described above concerning the angle $\theta_2$.

Furthermore, in the above embodiment, the tractive wires 75*b* and 75*c* are used in an uncovered state. Alternatively, the tractive wires 75*b* and 75*c* may be respectively inserted in flexible tubes (not shown) between the arcuate pieces 51*a* and 51*b* of the guide 52 of the button holding member 43 and the wire support 114 of the main attaching base 101.

The invention claimed is:

1. A helmet wherein a head protecting body to be worn on a head of a helmet wearer comprises a cap-like main cap portion and a subsidiary cap portion attached to said main cap portion by axial support means to be reciprocally pivotal so as to selectively cover a wearer's chin, said head protecting body is provided with a locking mechanism which locks said subsidiary cap portion with respect to said main cap portion when said subsidiary cap portion is in a backward state where said subsidiary cap portion covers the chin, said locking mechanism comprises a lock pin provided to said main cap portion, and a lock lever having a locking recess, with which said lock pin is engageable relatively when said subsidiary cap portion is in the backward state, and provided to said subsidiary cap portion, and an angle that a third straight line, which extends from a center of said lock pin in a direction along which said lock pin starts to relatively disengage from said locking recess in the backward state, seen from the side direction of said head protecting body, forms with a second straight line obtained by extending a first straight line, which extends from a center of said axial support means to the center of said lock pin in the backward state, seen from the side direction of said head protecting body, from the center of said lock pin in a direction opposite to the center of said axial support means so as to be substantially identical with the first straight line, falls within a range between an angle which is upward from the second straight line by 65° and an angle which is downward from the second straight line by 85°.

2. A helmet according to claim 1, wherein the angle that the third straight line forms with the second straight line falls within a range between an angle which is upward from the second straight line by 40° and an angle which is downward from the second straight line by 60°.

3. A helmet according to claim 1, wherein the angle that the third straight line forms with the second straight line falls within a range between an angle which is upward from the second straight line by 15° and an angle which is downward from the second straight line by 35°.

4. A helmet according to claim 1, wherein the angle that the third straight line forms with the second straight line is directed more downward from the second straight line by an angle larger than 0° and smaller than 20°.

5. A helmet according to claim 1, wherein the angle that the third straight line forms with the second straight line falls within a range between an angle which is downward from the second straight line by 5° and an angle which is downward from the second straight line by 15°.

6. A helmet according to claim 1, wherein said axial support means comprises an attaching screw.

7. A helmet according to claim 1, wherein while said subsidiary cap portion is in the backward state, a pivot fulcrum of said lock lever, seen from the side direction of said head protecting body when a lower end opening of said head protecting body is in a substantially horizontal state, is located above a horizontal line which extends through the center of said lock pin.

8. A helmet according to claim 7, wherein while said subsidiary cap portion is in the backward state, the pivot fulcrum of said lock lever, seen from the side direction of said head protecting body when a lower end opening of said head protecting body is in a substantially horizontal state, is located under a second horizontal line which extends through the center of said axial support means.

9. A helmet according to claim 7, wherein said pivot fulcrum of said lock lever comprises a rivet.

* * * * *